US007690637B2

(12) United States Patent
Yamamoto

(10) Patent No.: US 7,690,637 B2
(45) Date of Patent: Apr. 6, 2010

(54) SHEET PROCESSING APPARATUS AND SHEET PROCESSING METHOD

(75) Inventor: Mikio Yamamoto, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 560 days.

(21) Appl. No.: 11/670,085

(22) Filed: Feb. 1, 2007

(65) Prior Publication Data

US 2008/0185773 A1 Aug. 7, 2008

(51) Int. Cl.
*B65H 37/04* (2006.01)

(52) U.S. Cl. ..... 270/58.13; 270/59; 270/58.07; 270/58.08; 270/58.09; 270/58.28; 270/58.26; 270/58.19; 270/58.15

(58) Field of Classification Search ..... 270/58.01, 270/59, 58.07, 58.08, 58.09, 58.11, 58.13, 270/58.15, 58.19, 58.26, 58.28; 271/176
See application file for complete search history.

(56) References Cited

U.S. PATENT DOCUMENTS 5,634,632 A * 6/1997 Furuya et al. ..... 270/58.12
7,043,192 B2 * 5/2006 Terao et al. ..... 399/407
7,134,656 B2 * 11/2006 Terao et al. ..... 270/58.14
7,185,884 B2 * 3/2007 Terao et al. ..... 270/58.14
7,243,913 B2 * 7/2007 Terao et al. ..... 270/58.08
7,306,213 B2 * 12/2007 Terao et al. ..... 270/58.08
7,344,131 B2 * 3/2008 Terao et al. ..... 270/58.08
7,354,035 B2 * 4/2008 Terao et al. ..... 270/58.11
7,364,149 B2 * 4/2008 Terao et al. ..... 270/58.13
7,406,293 B2 * 7/2008 Terao et al. ..... 399/405
7,407,156 B2 * 8/2008 Iizuka et al. ..... 270/58.11
2006/0066024 A1 3/2006 Terao
2006/0066027 A1 3/2006 Terao
2006/0066034 A1 * 3/2006 Terao et al. ..... 270/58.11
2006/0066035 A1 * 3/2006 Terao et al. ..... 270/58.11
2006/0066036 A1 * 3/2006 Terao et al. ..... 270/58.11
2006/0066040 A1 * 3/2006 Terao et al. ..... 270/58.11
2006/0066041 A1 * 3/2006 Terao et al. ..... 270/58.11
2006/0067768 A1 3/2006 Terao
2006/0067772 A1 3/2006 Terao
2006/0071413 A1 * 4/2006 Kaneko et al. ..... 271/220
2006/0078363 A1 * 4/2006 Terao et al. ..... 399/407
2006/0157909 A1 * 7/2006 Terao et al. ..... 270/58.07
2006/0214343 A1 * 9/2006 Terao et al. ..... 270/58.08

(Continued)

FOREIGN PATENT DOCUMENTS

JP 2002-012358 1/2002

(Continued)

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet processing apparatus of the invention includes a post-processing unit that applies post-processing to sheets supplied from an image forming apparatus, a conveying tool that guides the sheets subjected to the post-processing to a discharge port, a sheet discharge tray that receives the sheets discharged from the discharge port, and a control unit that controls an operation of the conveying tool and stops a discharge operation for new sheets, when a quantity of the sheets stacked on the sheet discharge tray reaches a full state set in advance. The sheet processing apparatus further includes a pressing unit that temporarily prevents movement of the sheet on the conveying tool, when a sheet is present on the conveying tool in the full state.

9 Claims, 7 Drawing Sheets

U.S. PATENT DOCUMENTS

| | | | | |
|---|---|---|---|---|
| 2006/0214344 | A1* | 9/2006 | Terao et al. | 270/58.08 |
| 2006/0214345 | A1* | 9/2006 | Terao et al. | 270/58.08 |
| 2006/0214346 | A1* | 9/2006 | Terao et al. | 270/58.08 |
| 2007/0063410 | A1* | 3/2007 | Terao et al. | 270/58.09 |
| 2007/0063411 | A1* | 3/2007 | Hirano | 270/58.11 |
| 2007/0138728 | A1* | 6/2007 | Terao et al. | 270/58.09 |
| 2007/0138729 | A1* | 6/2007 | Terao et al. | 270/58.09 |
| 2007/0262510 | A1* | 11/2007 | Terao et al. | 270/58.11 |
| 2008/0061490 | A1* | 3/2008 | Terao et al. | 270/37 |
| 2008/0150212 | A1* | 6/2008 | Tsuchihashi | 270/58.07 |
| 2008/0157457 | A1* | 7/2008 | Harashina | 270/58.13 |

FOREIGN PATENT DOCUMENTS

| | | |
|---|---|---|
| JP | 2006-089198 | 4/2006 |

* cited by examiner

SHEET PROCESSING APPARATUS AND SHEET PROCESSING METHOD

BACKGROUND OF THE INVENTION

1. Field of the Invention

The present invention relates to a sheet processing apparatus for performing post-processing for sheets discharged from an image forming apparatus such as a copying machine, a printer, or a multifunction peripheral (MFP).

2. Description of the Related Art

In recent years, among image forming apparatuses, there is an image forming apparatus in which a sheet post-processing apparatus is provided adjacent to an image forming apparatus main body in order to perform post-processing such as processing for sorting sheets after image formation and processing for applying staple processing to the sheets.

In such a sheet post-processing apparatus, the sheets subjected to the post-processing are discharged to a sheet discharge tray. However, when sheets on the sheet discharge tray are in a full state, in removing the sheets in the full state, the sheets may fall.

In JP-A-2006-89198, a sheet stacking apparatus that stacks sheets outputted from an image forming apparatus is described. In this example, a sheet stacking apparatus that can perform warning of full stack or detection of full stack is described.

However, means for preventing fall of sheets in removing sheets in a full state is not described.

The present invention provides a sheet processing apparatus that takes measures when a volume of sheets stacked on a sheet discharge tray is in a full state.

DETAILED DESCRIPTION OF THE INVENTION

Figure 1:
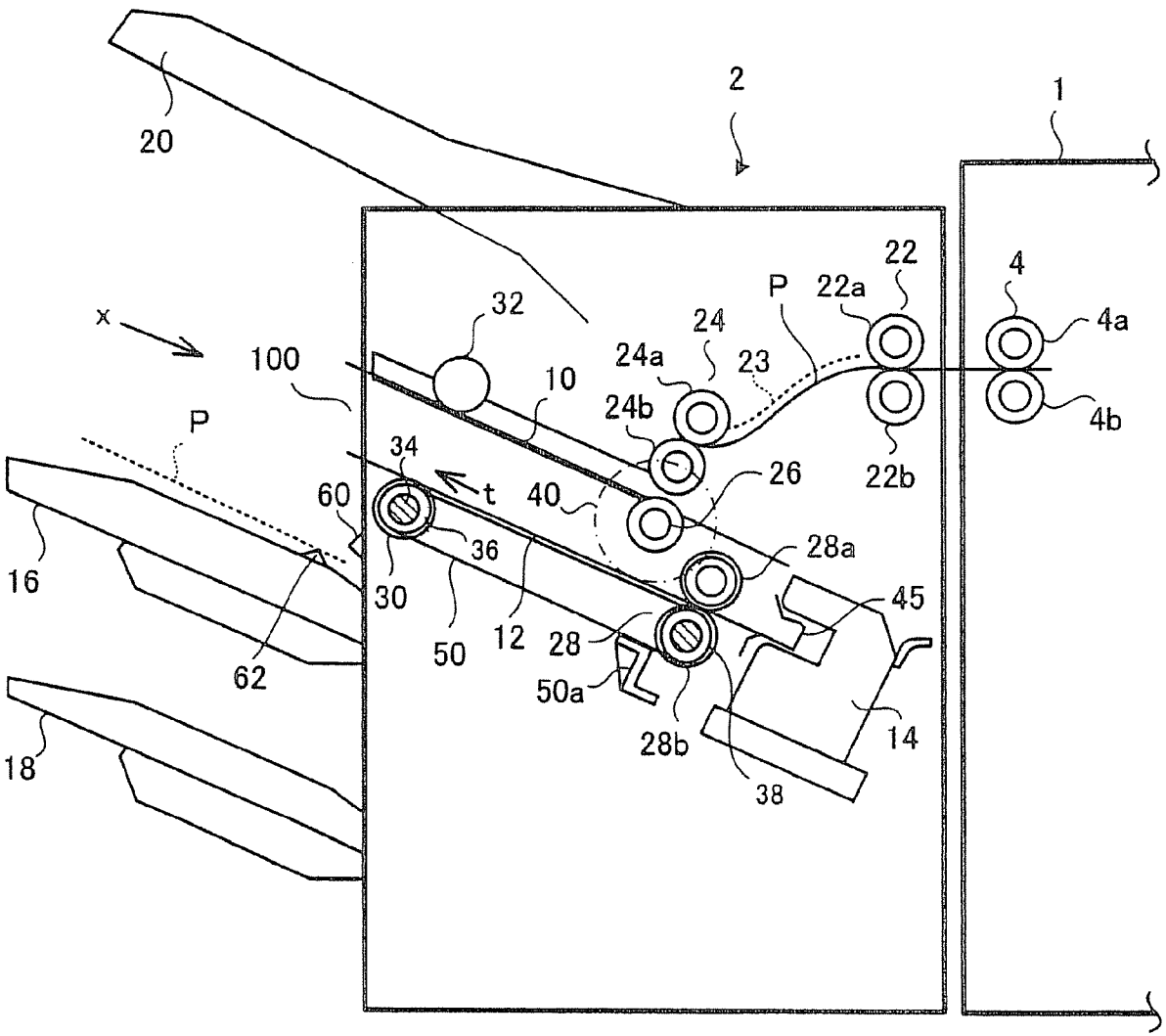
FIG. 1 is a schematic diagram showing a sheet processing apparatus according to an embodiment of the invention.

Throughout this description, the embodiments and examples shown should be considered as exemplars, rather than limitations on the apparatus of the present invention.

An embodiment of the invention will be hereinafter explained in detail with reference to the drawings. In the respective figures, identical components are denoted by identical reference numerals and signs.

FIG. 1 is a schematic diagram showing a sheet post-processing apparatus 2 arranged adjacent to an image forming apparatus 1 such as a copying machine. A sheet P having an image formed thereon by the image forming apparatus 1 is discharged from discharge rollers 4 and conveyed to the sheet post-processing apparatus 2. The discharge rollers 4 include an upper roller 4*a* and a lower roller 4*b*.

The sheet post-processing apparatus 2 has a standby tray 10, a processing tray 12, a stapler 14, a first sheet discharge tray 16, a second sheet discharge tray 18, and a fixed tray 20.

The sheet P discharged by the discharge rollers 4 of the image forming apparatus 1 is received by inlet rollers 22 provided near a delivery port of the sheet post-processing apparatus 2. The inlet rollers 22 include an upper roller 22*a* and a lower roller 22*b* and are driven by a motor (not shown).

Sheet feeding rollers 24 are provided on a downstream side of the inlet rollers 22. The sheet P received by the inlet rollers 22 is sent to the standby tray 10 via the sheet feeding rollers 24. A paper path 23 for guiding the sheet P to the sheet feeding rollers 24 is provided between the inlet rollers 22 and the standby tray 10. The sheet feeding rollers 24 include an upper roller 24*a* and a lower roller 24*b*.

The processing tray 12 for stacking the sheet P, which has dropped from the standby tray 10, is arranged below the standby tray 10. The standby tray 10 has a structure for stacking the sheet P and an openable structure. When a predetermined number of sheets P are accumulated, the standby tray 10 opens and the sheets P falls to the processing tray 12 because of an own weight of the sheets P. The processing tray 12 aligns and supports the sheets P while the sheets P are stapled by the stapler 14 serving as a post-processing mechanism.

The sheets, which have fallen in the processing tray 12, are guided to the stapler 14 by rollers 28 and subjected to staple processing. The rollers 28 include an upper roller 28*a* and a lower roller 28*b*. When the staple processing is performed, the plural sheets P, which have dropped from the standby tray 10 to the processing tray 12, are subjected to the staple processing after being aligned in the vertical direction, which is a conveying direction, and aligned in a horizontal direction orthogonal to the conveying direction.

A rotatable paddle 40 is arranged in a position to which the trailing end of the sheet P falls when the sheet P falls to the processing tray 12.

Figure 4:
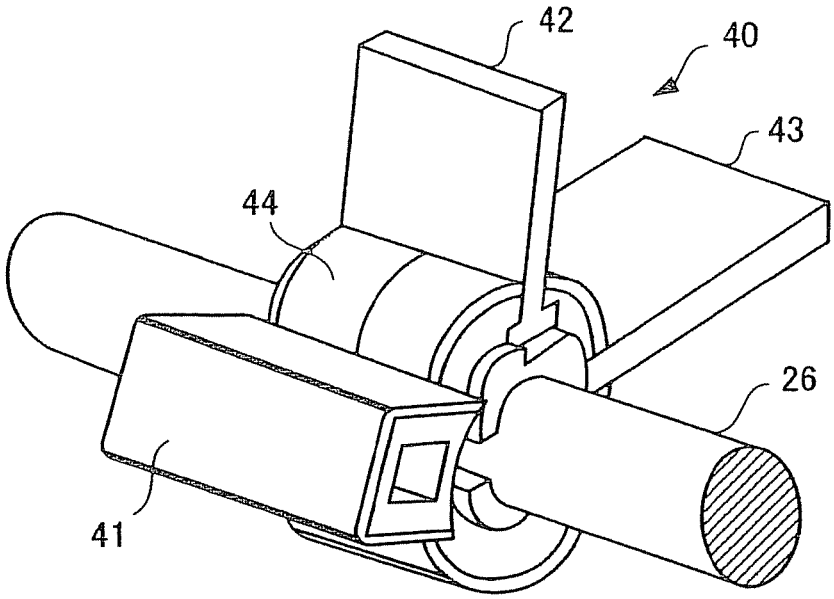
FIG. 4 is a perspective view showing a structure of a paddle used in the sheet processing apparatus of the invention.
Figure 5:
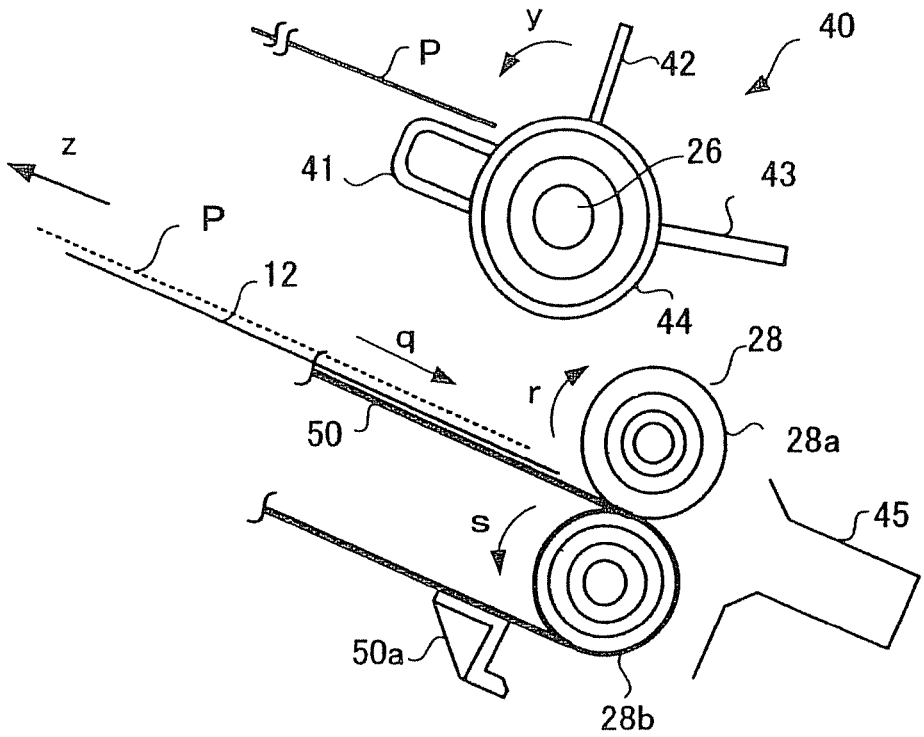
FIG. 5 is an explanatory view of an operation of the paddle used in the sheet processing apparatus of the invention.

The paddle 40 is attached to a rotating shaft 26. The paddle 40 pats down the sheet P falling from the standby tray 10 onto the processing tray 12 and sends the sheet P in a direction of the stapler 14. Details of the paddle 40 are shown in FIGS. 4 and 5 and described later.

A stopper 45 that regulates the trailing end position of the sheet P is provided at an end on the stapler 14 side of the processing tray 12. There is also provided a conveyor belt 50 as a conveying tool that conveys the sheets P, which are subjected to sort processing or staple processing, to the first sheet discharge tray 16 or the second sheet discharge tray 18.

The conveyor belt 50 is suspended between pulleys 36 and 38. A pawl member 50*a* that hooks the trailing end of the sheets P and sends the sheets P is attached to the conveyor belt 50. The lower roller 28*b* of the rollers 28 is arranged coaxially with the pulley 38. The rollers 28 rotate in opposite directions when the rollers 28 guide aligned sheets in the direction of the stapler 14 and when the rollers 28 discharge the sheets P subjected to the staple processing.

The pulley 36 is attached to a shaft 34. Plural discharge rollers 30 are rotatably attached to this shaft 34.

The sheets P conveyed by the conveyor belt 50 are discharged to the first sheet discharge tray 16 or the second sheet discharge tray 18 from a discharge port 100. The first sheet discharge tray 16 and the second sheet discharge tray 18 are lifted and lowered by a driving unit (not shown) and receive the sheets P.

The sheets P stacked on the standby tray 10 may be discharged to the first sheet discharge tray 16 or the second sheet discharge tray 18 without being subjected to the staple processing. In this case, the sheets P are discharged by a roller 32 without being caused to fall to the processing tray 12.

It is also possible to discharge the sheets P not required to be subjected to post-processing to the fixed tray 20. A conveying path is provided to guide the sheets P to the fixed tray 20. The conveying path is not shown in the figure.

Figure 2:
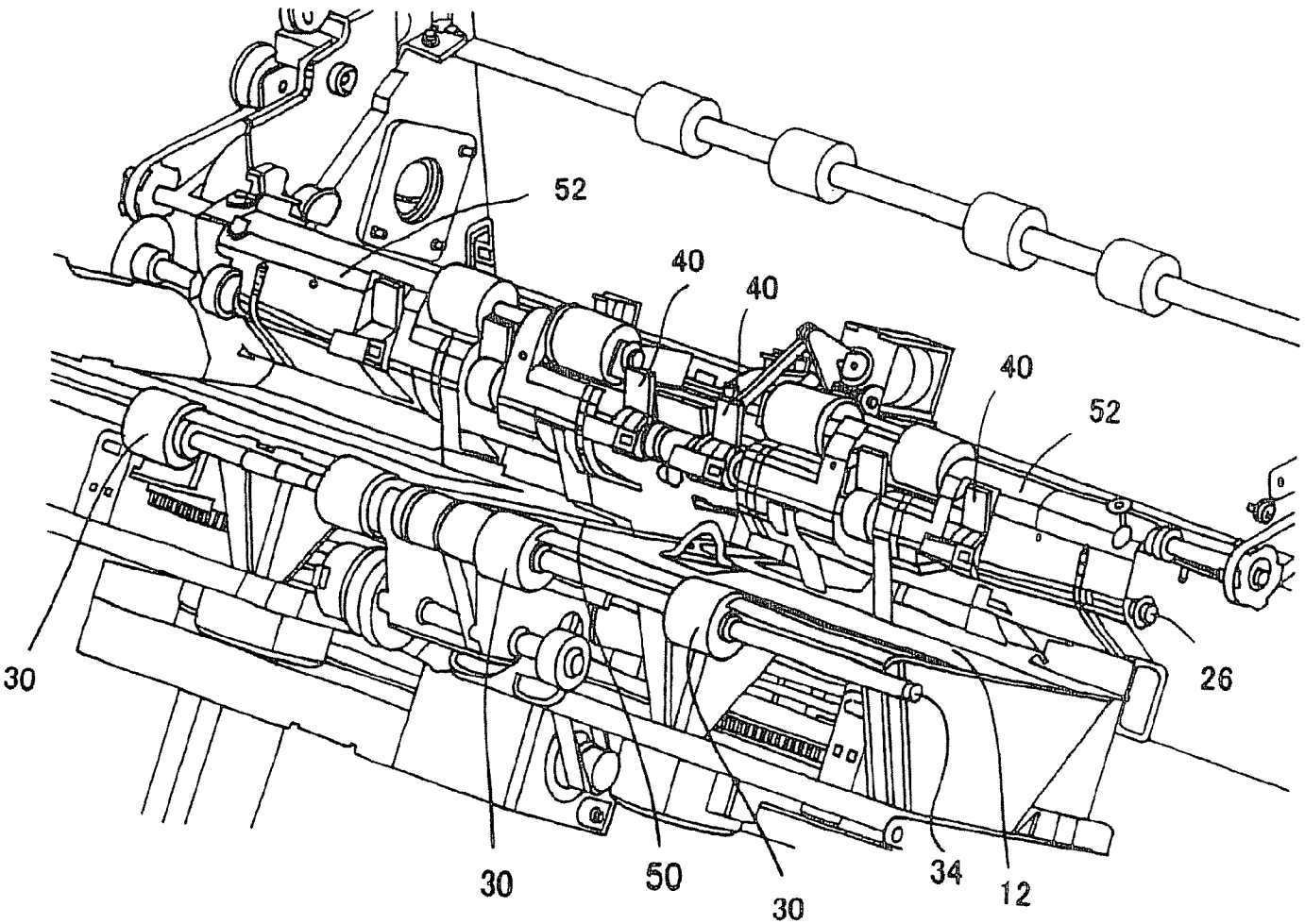
FIG. 2 is a perspective view of a main part of the sheet processing apparatus of the invention viewed from a sheet discharge port side.

FIG. 2 is a perspective view of a main part of the sheet post-processing apparatus 2 and is a diagram of the main part viewed from an arrow x direction in FIG. 1.

In FIG. 2, the shaft 34 is arranged orthogonal to the conveying direction of the sheets P. The pulley 36 is attached to the middle of the shaft 34. The belt 50 is looped around this pulley 36. The discharge rollers 30 are attached to the center and both the sides of the shaft 34. The discharge rollers 30 are subjected to rotation control by the driving unit and rotate when the sheets P are discharged to the tray 16 or 18.

Figure 3:
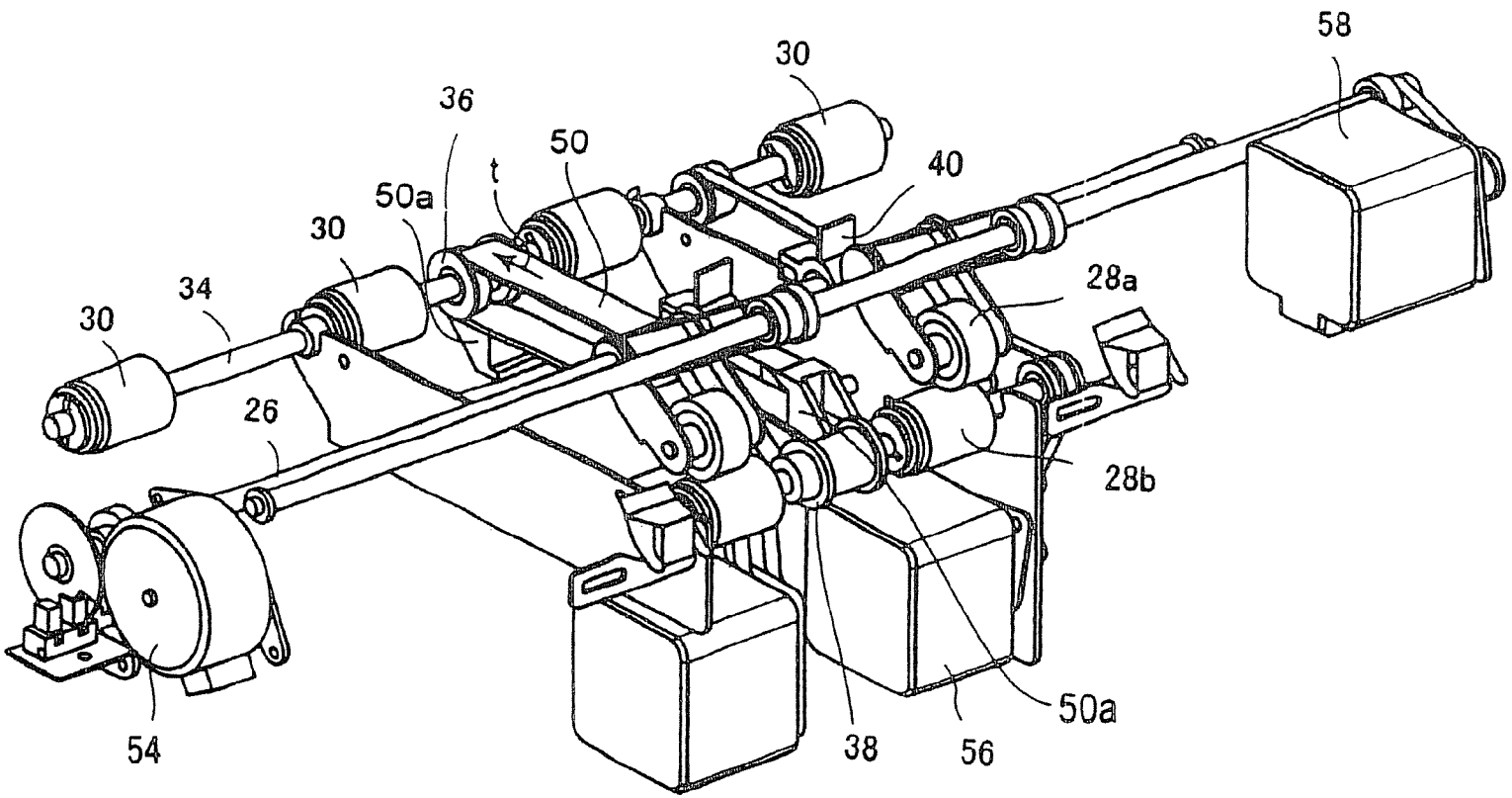
FIG. 3 is a perspective view showing a structure of the main part of the sheet processing apparatus of the invention.

FIG. 3 is a schematic perspective view showing structures of the rollers 28 for vertical alignment of the sheets P, the paddles 40, and the conveyor belt 50. As shown in FIG. 3, the conveyor belt 50 is suspended between the pulleys 36 and 38 and driven to rotate by a motor 56. The conveyor belt 50 cyclically rotates between the stapler 14 and the sheet discharge port 100 (FIG. 1) along a discharge direction of sheets.

In conveying the sheets P in the direction of the sheet discharge trays 16 and 18, the conveyor belt 50 moves in an arrow t direction and the upper roller 28*a* and the lower roller 28*b* for vertical alignment rotate in an arrow r direction and an arrow s direction in FIG. 5. The upper roller 28*a* for vertical alignment is driven to rotate by a motor 58 and the lower roller 28*b* is driven to rotate by the motor 56 that drives the conveyor belt 50.

A plurality of the paddles 40 are attached to the rotating shaft 26. The rotating shaft 26 is driven to rotate by the motor 54. Alternatively, a rotational force of a motor may be transmitted to the rotating shaft 26 via a gear mechanism.

FIG. 4 shows a structure of the paddle 40 in enlargement. In the paddle 40, an attachment member 44 is attached to the rotating shaft 26. The attachment member 44 includes a receiving section 41 that receives the trailing end of the sheet P that is placed in the standby tray 10, a patting section 42 that pats down the sheet P onto the processing tray 12, and a sending section 43 that sends the sheet P on the processing tray 12 in the direction of the stapler 14. The patting section 42 and the sending section 43 of the paddle 40 are made of a rubber material and have elasticity.

FIG. 5 is a diagram for explaining an operation of the paddle 40. A state in FIG. 5 is a home position of the paddle 40. In this position, the paddle 40 receives the trailing end of the sheet P falling from the standby tray 10.

The paddle 40 rotates in a y direction with the home position as a base point, pats down the trailing end of the sheet P received by the receiving section 41 onto the processing tray 12 with the patting section 42, and sends the sheet P in the direction of the stapler 14 with the sending section 43.

When the sheet P on the processing tray 12 is sent in the direction of the stapler 14 (an arrow q), the upper roller 28*a* of the roller 28 rotates counterclockwise and the lower roller 28*b* rotates clockwise. When the sheet P on the processing tray 12 is discharged, the upper roller 28*a* rotates in the arrow r direction and the lower roller 28*b* rotates in the arrow s direction.

As it is seen from FIG. 2, the plurality of the paddles 40 are attached to the rotating shaft 26. A guide member 52 is provided in order to guide sheets to the processing tray 12. The guide member 52 serves as a guide in pulling the trailing end of the sheet P conveyed into the stapler 14 side.

Driving units such as the motors 54, 56, and 58 that drive the various mechanisms described above are controlled to be driven by a control circuit.

An operation of the post-processing by the sheet post-processing apparatus 2 will be explained according to a flow of sheets. Sheets subjected to the post-processing are discharged to the sheet discharge tray 16 or 18. In the following explanation, as a representative example, the sheets are discharged to the sheet discharge tray 16.

The sheets P conveyed from the inlet rollers 22 via the paper path ceiling 23 are fed onto the standby tray 10 by the sheet feeding rollers 24. Subsequently, the sheets P fall onto the standby tray 10.

When the sheets P fall, the upper roller 28*a* for vertical alignment is retracted upward and the receiving section 41 of the paddle 40 receives the trailing end of the sheets P. Both the ends of the sheets P fall in contact with horizontal aligning plates (not shown) and alignment in the horizontal direction is performed.

Subsequently, the paddles 40 rotate in the arrow y direction as shown in FIG. 5, the trailing end of the sheets P falls from the receiving sections 41, and the sheets P are patted down onto the processing tray 12 by the patting sections 42. Moreover, the paddles 40 send the sheets P in an arrow q direction with the sending section 43, bring the trailing end of the sheets P into contact with the stoppers 45, and complete the alignment in the vertical direction of the sheets P.

In this way, the sheets P having images formed thereon are guided from the sheet feeding rollers 24 to the processing tray 12 while being sequentially aligned in the horizontal and the vertical directions.

In performing the staple processing, when the sheets P stacked on the processing tray 12 reach a predetermined number, the stapler 14 staples the sheets P on the processing tray 12 in a desired position and forms a sheet bundle. Thereafter, as shown in FIG. 5, the sheet bundle is nipped by the upper roller 28*a*, which rotates in the arrow r direction, and the lower roller 28*b*, which rotates in the arrow s direction, and conveyed in the direction of the sheet discharge tray 16.

When the trailing end of the sheet bundle passes the rollers 28*a* and 28*b*, the sheet bundle is hooked by the sending pawl 50*a* of the conveyor belt 50, which is rotated in the arrow t direction, conveyed to the sheet discharge tray 16, and thereafter discharged onto the sheet discharge tray 16 by the discharge rollers 30.

It is also possible to shift the sheets in the width direction by operating the horizontal aligning plates and sort and discharge the sheets.

The operations of the entire sheet post-processing apparatus 2 are explained above. A structure of a sheet discharging unit for sheet discharge to the sheet discharge tray 16, which is a characteristic part of the invention, will be explained.

As shown in FIG. 1, the sheet discharging unit is provided with a first sensor 60 near the discharge port 100 of the sheet post-processing apparatus 2. The sensor 60 detects an uppermost surface of sheets discharged onto the sheet discharge tray 16. The sheet discharging unit controls a height position of the sheet discharge tray 16 in response to a result of detection by this sensor 60.

A second sensor 62 is attached to the sheet discharge tray 16 and detects presence or absence of a sheet on the sheet discharge tray 16. The second sensor 62 is a weight sensor.

When the sheet P is discharged on to the sheet discharge tray 16, it is possible to detect the sheet P with the sensor 62.

Figure 6:
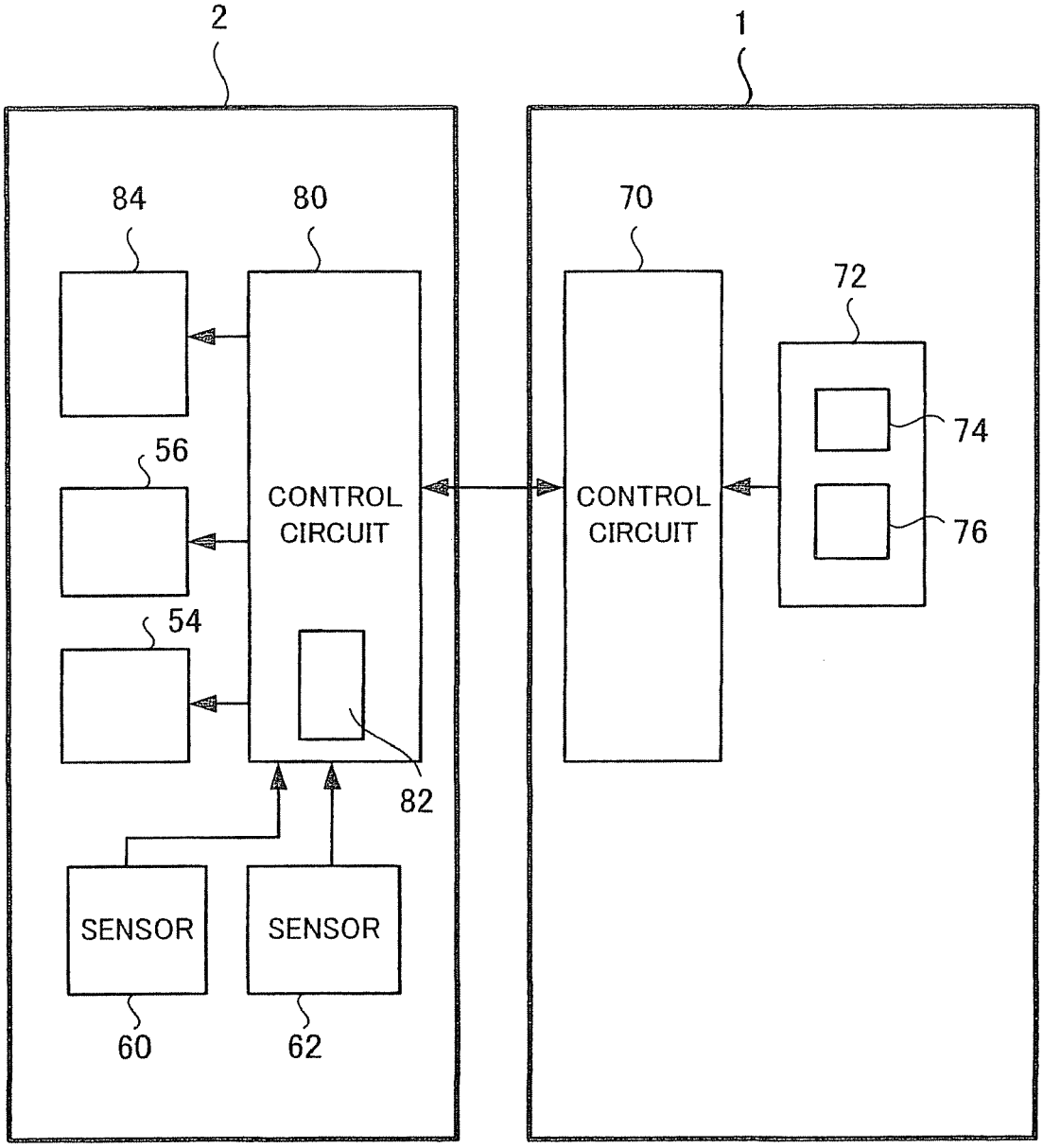
FIG. 6 is a block diagram showing a control system for the sheet processing apparatus of the invention.

FIG. 6 is a block diagram showing a control system that controls the sheet discharging unit. In FIG. 6, reference numeral 70 denotes a control circuit that performs control of the image forming apparatus 1. For example, the control unit is constituted by a microprocessor including a CPU. The control unit performs, for image formation, control of the respective units in response to operation of an operation unit 72.

The operation unit 72 has various keys 74 and a display unit 76 of a touch panel type. For example, the user performs instructions for the number of copies and the like using the keys 14 and performs instructions for a sheet size, a sheet type, stapling, and the like by operating the touch panel of the display unit 76.

Reference numeral 80 denotes a control circuit that performs control of the sheet post-processing apparatus 2. For example, the control circuit 80 is constituted by a microprocessor including a CPU. The control circuit 80 performs transmission and reception of information to and from the control circuit 70 of the image forming apparatus 1 and performs, for sheet post-processing, control of the respective units such that the operation of image formation and the operation of the sheet post-processing apparatus 2 cooperate with each other.

The control circuit 80 performs control of a motor 84 that lifts and lowers the sheet discharge trays 16 and 18, a motor 56 that drives a conveying tool (the conveyor belt 50), and a motor 54 that rotates the paddles 40. In other words, the control circuit 80 constitutes a sheet-discharge-tray control unit that controls lifting and lowering of the sheet discharge trays 16 and 18, a discharge control unit that controls discharge of sheets by the conveyor belt 50, and a paddle control unit that controls the rotation of the paddles 40.

The sending pawl 50*a* that hooks the trailing end of a sheet bundle T is attached to the conveyor belt 50. The sending pawl 50*a* conveys the sheets P or the sheet bundle subjected to the post-processing to the discharge port 100 according to the rotation of the conveyor belt 50. Moreover, detection results from the sensors 60 and 62 are inputted to the control circuit 80. The control circuit 80 has a counter 82 that operates in response to the detection result of the sensor 62.

Figure 7A:
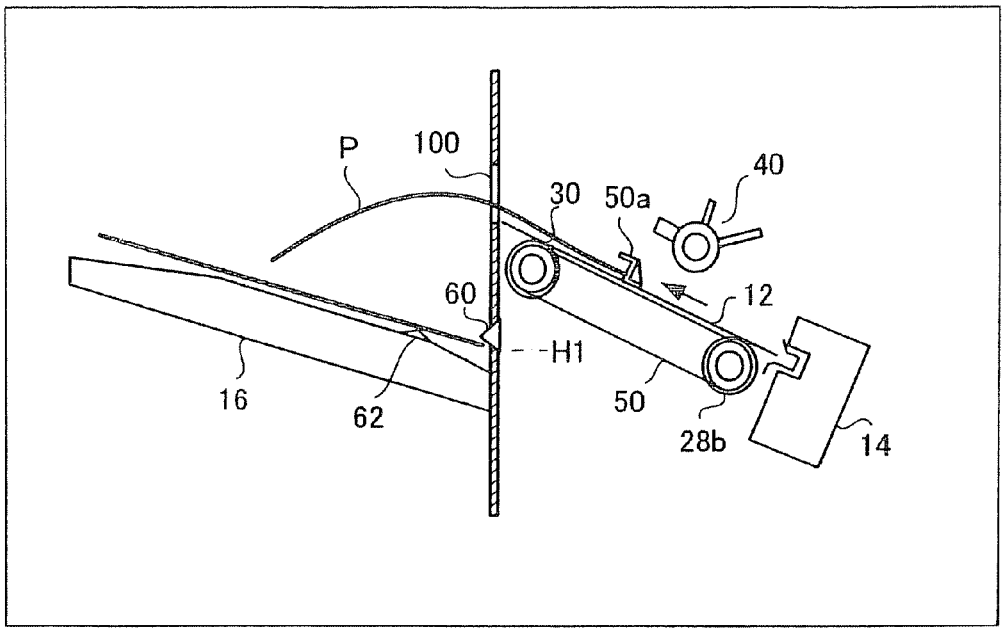
FIGS. 7A and 7B are explanatory diagrams for explaining operations of a sheet discharging unit in the sheet processing apparatus of the invention.
Figure 7B:
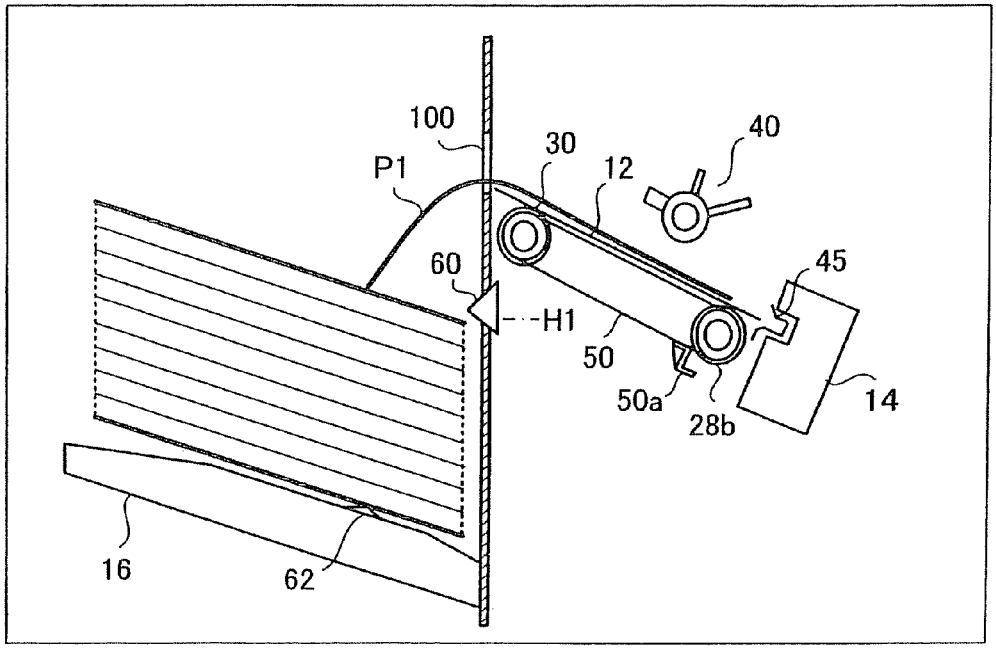

FIGS. 7A and 7B are diagrams for explaining operations of the sheet discharging unit according to the control by the control circuit 80. The control circuit 80 lifts and lowers the sheet discharge tray 16 in response to the detection results of the sensors 60 and 62.

The sheets P subjected to the sort processing or the sheet bundle subjected to the staple processing are discharged to the sheet discharge tray 16 by the sending pawl 50*a* according to the rotation of the conveyor belt 50. In this explanation, it is assumed that the sheets P are discharged.

When the conveyor belt 50 rotates, the sending pawl 50*a* conveys the sheets P to the discharge port 100 and discharges the sheets P to the sheet discharge tray 16. The sensor 62 provided in the sheet discharge tray 16 detects that the sheets P are discharged to the sheet discharge tray 16 and starts a count operation by the counter 82 of the control circuit 80.

The counter 82 assumes a role of sequentially counting the number of the sheets P discharged from the image forming apparatus 1 and, when the number of the sheets P stacked on the sheet discharge tray 16 reaches a number set in advance, notifying the user to that effect with an alarm or the like. In other words, the counter 82 is used to inform the user that the tray 16 is in the full state.

As shown in FIG. 7A, the sheet discharge tray 16 is on standby in a height position H1 near the first sensor 60. As the sheets P stacked on the sheet discharge tray 16 increase, the sheet discharge tray 16 descends to prevent the upper surface of the sheets P on the sheet discharge tray 16 from exceeding the first height position H1.

The sheet discharge tray 16 falls once every time the sheet P is discharged and rises again. When the upper surface of the sheets P on the sheet discharge tray 16 is detected by the sensor 60, the sheet discharge tray 16 stops in that position to always keep the upper surface of the sheets P in the first height position H1.

FIG. 7B shows a state in which the sheets P stacked in the sheet discharge tray 16 are full. When the sheets P reach the full state, it is notified to the user that the sheets P have reached the predetermined number using the output of the counter 82. The conveyor belt 50 stops to stop further discharge of the sheets P. In this state, the paddle 40 is also in the state of the home position.

Figure 8A:
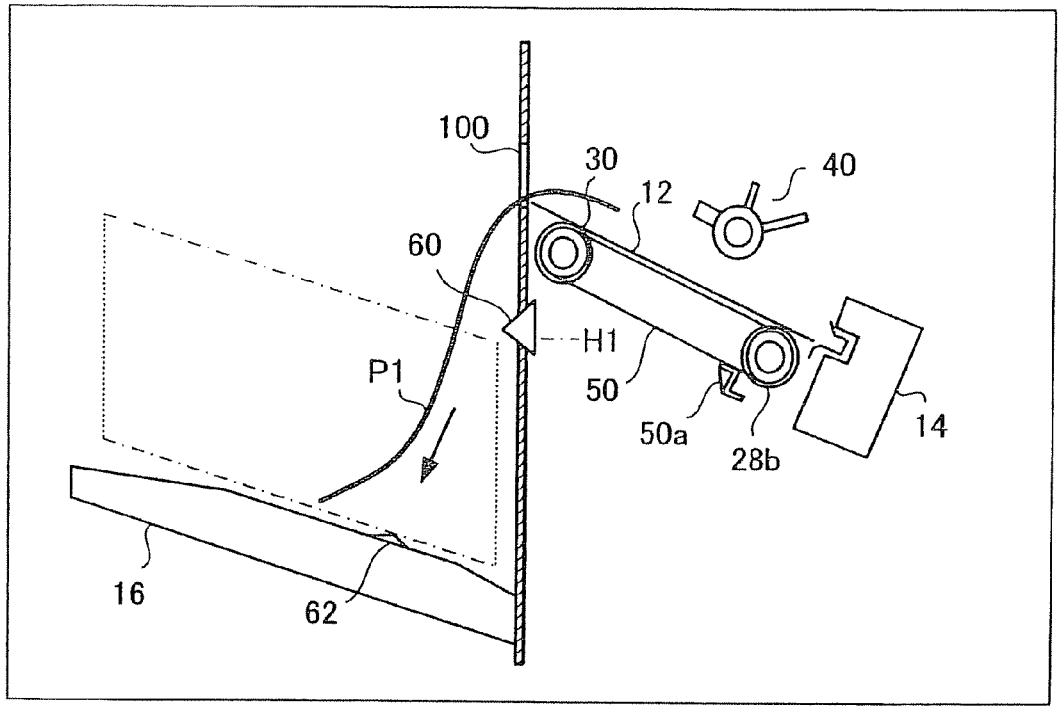
FIGS. 8A and 8B are other explanatory diagrams for explaining operations of the sheet discharging unit in the sheet processing apparatus of the invention.

In this state, the user removes the sheets P stacked on the sheet discharge tray 16. FIG. 8A shows a state in which the stacked sheets are removed. In this case, the sheet discharge tray 16 remains lowered and there is a gap between a sheet discharge surface and the sheet discharge tray 16. Since the sheet P1 remains on the conveyor belt 50, the sheet P1 falls because of its own weight or alignment is disordered. This phenomenon is more conspicuous as a sheet size is larger.

The sheet discharge tray 16 gradually rises to the height position H1 and waits for discharge of a new sheet again. However, alignability of the sheets P1 on the sheet discharge tray 16 is deteriorated.

Thus, in the invention, when the sheets P on the sheet discharge tray 16 are in the full state, the rotation of the paddle 40 is controlled to prevent the sheets P1 from falling or prevent alignment from being disordered.

Figure 8B:
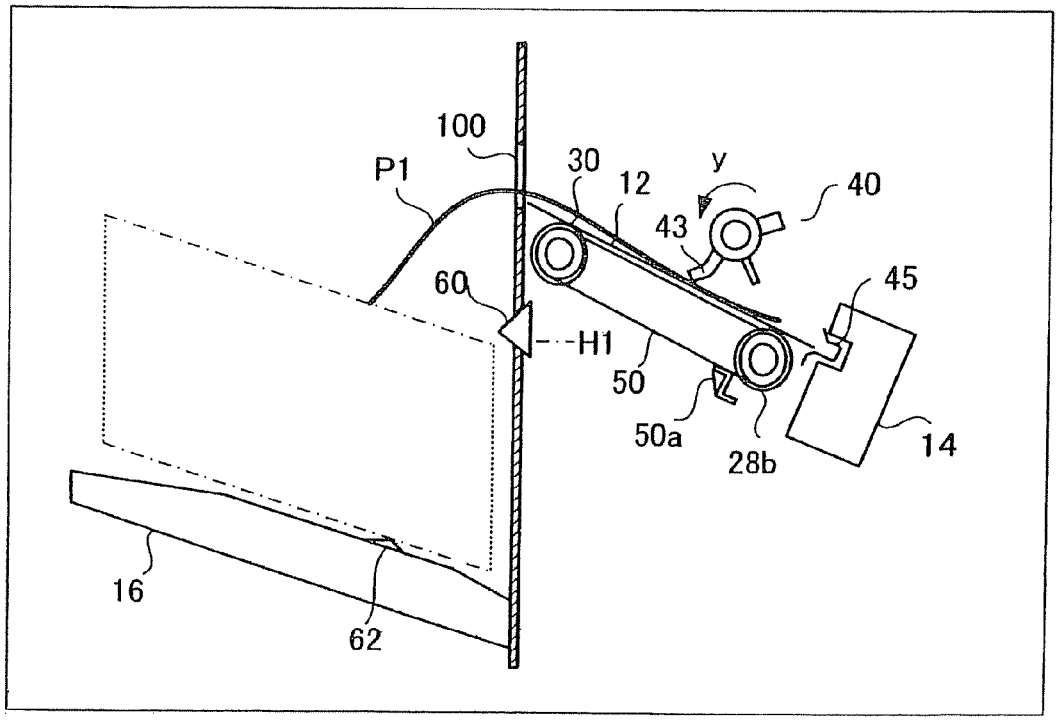

As shown in FIG. 8B, when the sheet discharge tray 16 is in the sheet full state, the paddle 40 slowly rotates, presses the sending unit 43 against the sheet P1 on the conveyor belt 50, and stops in that state.

Consequently, since the sheet P1 is pressed by the sending unit 43 of the paddle 40, even if the sheets stacked on the sheet discharge tray 16 are removed, the sheet P1 does not fall because of its own weight and is not disarranged.

When the sheet discharge tray 16 reaches the sheet full state, the control circuit 80 rotates the motor 54, which drives the paddle 40, on the basis of a count result of the counter 82 and stops the paddle 40 at a predetermined rotation angle. Consequently, it is possible to shift to the state in FIG. 8B. If a stepping motor is used as the motor 54, it is easy to control a rotation angle of the paddle 40. In this case, the paddle 40 rotates at speed lower than rotation speed at the time of normal sheet sending. This is for the purpose of preventing the sheet P1 from being fed backward in the direction of the stopper 45 to be bent.

When the sheets stacked on the sheet discharge tray 16 are removed, the second sensor 62 detects that there is no sheet and resets the counter 82 to an initial value. Consequently, count of the number of sheets is started anew. The paddle 40 returns to the home position and starts the normal sheet sending operation.

Sheets subjected to the sort processing and the sheet bundle subjected to the staple processing is discharged to the sheet discharge tray 16. When the sheet discharge tray 16 is in the sheet full state, at that point, the sheet P or the sheet bundle on the conveyor belt 50 is pressed by the paddle 40.

In this way, according to the invention, when sheets are discharged to the sheet discharge tray and the sheet discharge tray is in the sheet full state, even if the sheets stacked on the sheet discharge tray are removed, it is possible to prevent a situation in which a sheet on the conveyor belt falls and alignability is deteriorated.

The invention is not limited to the above explanation. Various modifications are possible in a range not departing from the scope of the claims. For example, in the above explanations, the number of sheets discharged to the sheet discharge tray is counted to detect the sheet full state. However, the sheet full state may be determined by detecting that a height position of the sheet discharge tray falls below a predetermined position.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet processing apparatus comprising:

a sheet conveying path that brings in sheets discharged from an image forming apparatus and guides the sheets to a standby tray;

a processing tray that is provided below the standby tray and is capable of receiving the sheets supplied from the standby tray and placing the sheets thereon;

a post-processing unit configured to apply post-processing to the sheets placed on the processing tray;

a sheet discharging unit configured to have a conveying tool that discharges the sheets subjected to the post-processing by the post processing mechanism;

a paddle that is attached to a rotating shaft arranged in a direction orthogonal to a conveying direction of the sheets and for guiding the sheets supplied from the standby tray to the processing tray, the paddle including a receiving unit that receives an end of a sheet supplied from the standby tray and a sending unit that is arranged at a predetermined angle with respect to the receiving unit and sends the sheets on the processing tray to the post-processing mechanism;

a sheet discharge tray that receives the sheets discharged from the discharge port;

a tray control unit that controls a height position of the sheet discharge tray such that a sheet on an uppermost surface of the sheets stacked on the sheet discharge tray is in a predetermined height position;

a discharge control unit that controls an operation of the sheet discharging unit and stops discharge of new sheets, when a quantity of the sheets stacked on the sheet discharge tray reaches a full state set in advance; and a paddle control unit that rotates the paddle a predetermined angle and temporarily presses the sheet on the conveying tool with the pressing unit, when a sheet is present on the conveying tool in the full state.

2. A sheet processing apparatus according to claim 1, further comprising a first sensor that detects an uppermost surface of the sheets stacked on the sheet discharge tray, wherein the tray control unit controls a height position of the sheet discharge tray in response to a result of the detection by the first sensor.

3. A sheet processing apparatus according to claim 1, further comprising a second sensor that detects that sheets are stacked on the sheet discharge tray, wherein the discharge control unit counts a quantity of sheets discharged to the sheet discharge tray, from a point when the stack of the sheets is detected by the second sensor.

4. A sheet processing apparatus according to claim 1, wherein the paddle control unit rotates the paddle a predetermined angle at speed lower than speed at a normal time and rotates, when the sheets stacked on the sheet discharge tray reach the full state.

5. A sheet processing apparatus according to claim 1, wherein the paddle is formed by attaching, in a radial shape around the rotating shaft, the receiving unit configured to receive an end of a sheet supplied from the standby tray, a patting unit configured to pat down a sheet separated from the receiving unit to the processing tray, and the sending unit configured to send the sheets in the processing tray to the post-processing mechanism.

6. A sheet processing apparatus according to claim 1, wherein the pressing unit of the paddle is made of an elastic member.

7. A sheet processing apparatus according to claim 1, wherein the post-processing unit applies staple processing or sort processing to the sheets.

8. A sheet processing method comprising:

sending sheets supplied from an image forming apparatus to a post-processing unit with a paddle having a rotatable sending unit;

discharging the sheets subjected to post-processing by the post-processing unit from a discharge port using a conveying tool;

receiving the sheet discharged from the discharge port with a sheet discharge tray;

controlling a height position of the sheet discharge tray such that a sheet on an uppermost surface of the sheets stacked on the sheet discharge tray is at a predetermined height position;

stopping an operation of the conveying tool when a quantity of the sheets stacked on the sheet discharge tray reaches a full state set in advance; and rotating the paddle a predetermined angle when a sheet is present on the conveying tool in the full state and temporarily pressing the sheet on the conveying tool with the sending unit.

9. A sheet processing method according to claim 8, wherein the height position of the sheet discharge tray is returned to a standby position and the paddle is rotated to be brought into an initial state set in advance when the sheets placed on the sheet discharge tray are removed.

* * * * *